US008450665B2

(12) United States Patent
Ogasawara et al.

(10) Patent No.: US 8,450,665 B2
(45) Date of Patent: May 28, 2013

(54) INDUCTION HEATING COOKER INCLUDING AN INFRARED RAY SENSOR AND DETECTING WHETHER THERE IS A FAILURE IN THE INFRARED RAY SENSOR

(75) Inventors: Fumitaka Ogasawara, Hyogo (JP); Keiko Isoda, Hyogo (JP); Hiroshi Tominaga, Hyogo (JP); Masamichi Komada, Hyogo (JP)

(73) Assignee: Panasonic Corporation, Osaka (JP)

( * ) Notice: Subject to any disclaimer, the term of this patent is extended or adjusted under 35 U.S.C. 154(b) by 369 days.

(21) Appl. No.: 12/666,091

(22) PCT Filed: Jun. 23, 2008

(86) PCT No.: PCT/JP2008/001616
§ 371 (c)(1),
(2), (4) Date: May 25, 2010

(87) PCT Pub. No.: WO2009/001541
PCT Pub. Date: Dec. 31, 2008

(65) Prior Publication Data

US 2010/0243641 A1 Sep. 30, 2010

(30) Foreign Application Priority Data

Jun. 22, 2007 (JP) ..... 2007-164612

(51) Int. Cl.
*H05B 6/12* (2006.01)

(52) U.S. Cl.
USPC ..... 219/627; 219/620; 219/625

(58) Field of Classification Search
USPC ..... 219/620–627
See application file for complete search history.

(56) References Cited

U.S. PATENT DOCUMENTS 6,140,617 A 10/2000 Berkcan
6,492,627 B1 * 12/2002 Ensinger et al. ..... 219/518

(Continued)

FOREIGN PATENT DOCUMENTS

JP 10-47687 2/1998
JP 2003-282227 10/2003

(Continued)

OTHER PUBLICATIONS

Form PCT/IB/338 together with International Preliminary Report on Patentability and translation of PCT Written Opinion mailed Jan. 21, 2010 for International (PCT) Application No. PCT/JP2008/001616.

(Continued)

*Primary Examiner* — Fernando L Toledo
*Assistant Examiner* — Peter Bradford
(74) *Attorney, Agent, or Firm* — Wenderoth, Lind & Ponack, L.L.P.

(57) ABSTRACT

An induction heating device according to the present invention includes an infrared ray sensor for detecting infrared rays radiated from a cooking container through a top plate, a light emitting device which is placed near the infrared ray sensor and emits light to the back surface of the top plate, and a heating control unit which controls a high-frequency current through a heating coil for controlling the heating of the cooking container. When the heating control unit has stopped the heating of the cooking container, and a predetermined time elapses at the heating-stopped state, the light emitting device is controlled to stop the light emission therefrom. This can improve durability of the light emitting device, which enables maintaining a function of clearly indicating a position at which the cooking container should be placed and a function of detecting failures in the infrared ray sensor, which are roles of the light emitting device.

7 Claims, 4 Drawing Sheets

U.S. PATENT DOCUMENTS

| | | | | |
|---|---|---|---|---|
| 2003/0006230 | A1* | 1/2003 | Kaji et al. | 219/620 |
| 2003/0095034 | A1* | 5/2003 | Clothier | 340/10.1 |
| 2003/0164370 | A1* | 9/2003 | Aihara et al. | 219/622 |
| 2005/0115957 | A1* | 6/2005 | Kataoka et al. | 219/620 |
| 2007/0080158 | A1 | 4/2007 | Takimoto | |
| 2008/0099449 | A1* | 5/2008 | England et al. | 219/121.48 |
| 2009/0134149 | A1* | 5/2009 | Keishima et al. | 219/647 |
| 2009/0152260 | A1* | 6/2009 | Fujinami et al. | 219/600 |

FOREIGN PATENT DOCUMENTS

| | | | |
|---|---|---|---|
| JP | 2004327053 | A * | 11/2004 |
| JP | 2004-355895 | | 12/2004 |
| JP | 2005-038660 | | 2/2005 |
| JP | 2005216585 | A * | 8/2005 |
| JP | 2006-294369 | | 10/2006 |
| WO | 98/05904 | | 2/1998 |
| WO | 2007/055218 | | 5/2007 |

OTHER PUBLICATIONS

International Search Report issued Sep. 9, 2008 in International (PCT) Application No. PCT/JP2008/001616.

Supplementary European Search Report mailed Jun. 1, 2012 in corresponding European Application No. EP 08 76 4199.

* cited by examiner

INDUCTION HEATING COOKER INCLUDING AN INFRARED RAY SENSOR AND DETECTING WHETHER THERE IS A FAILURE IN THE INFRARED RAY SENSOR

TECHNICAL FIELD

The present invention relates to an induction heating cooker employing an infrared ray sensor for use in ordinary households and restaurants.

BACKGROUND ART

A conventional induction heating cooker includes an infrared ray sensor 45 placed at a center of a heating coil 43 as illustrated in FIG. 5, and a control unit 48 controls an output of an inverter circuit 44 according to an output from the infrared ray sensor 45. Above the infrared ray sensor 45, there is placed a waveguide 46 made of a nonmagnetic metal material. The waveguide 46 directs only infrared rays radiated from a load pan 41 to the infrared ray sensor 45. Around the waveguide 46, there are placed a first magnetic shielding member 49 and a second magnetic shielding member 50 for alleviating heat generation from the waveguide 46 itself due to magnetic fluxes from the heating coil 43. The first magnetic shielding member 49 is placed below the heating coil 43, and the second magnetic shielding member 50 is placed inside the heating coil 43. Thus, such a conventional induction heating cooker has eliminated an influence of infrared ray radiation from portions other than the bottom portion of the load pan 41 (refer to Patent Document 1: JP-A No. 2005-38660, for example).

SUMMARY OF THE INVENTION

Problems to be Solved by the Invention

However, in the conventional structure, an output of the infrared ray sensor 45 changes only when an amount of radiation of infrared rays from the load pan 41 has increased, thereby inducing a problem that it is impossible to perform temperature detection if the load pan 41 is not properly placed above the infrared ray sensor 45. Further, even when the top plate 42 is provided with a print which enables a user to recognize where the infrared ray sensor 45 is placed, the print cannot be easily viewed when the induction heating cooker is used in a dark environment. Therefore, in the conventional structure, the infrared ray sensor 45 is placed substantially at the center of the heating coil 43, in order to enable the user to place the load pan 41 above the infrared ray sensor 45 without being aware of the position of the infrared ray sensor 45.

On the other hand, the conventional structure has another problem that it is possible to detect abnormalities in the infrared ray sensor 45 and a temperature calculating unit 47 only when the temperature of the load pan 41 has been raised. Further, in cases of using an infrared ray sensor 45 having a peak sensitivity wavelength of about 1 μm, the output of the infrared ray sensor 45 does not change until the temperature of the load pan 41 reaches a high temperature equal to or higher than 200° C. Therefore, at the time when an abnormality as described above is detected through self diagnosis using a thermistor or the like placed near the infrared ray sensor 45, the temperature of the pan might have reached an abnormality-high temperature. Accordingly, the use of the temperature detection using the infrared ray sensor 45 has been restricted to use for temperature ranges up to about 100° C. for boiling water or cooking rice.

As means for overcoming the above-described problem, there has been means which provides a light emitting element constituted by an LED or the like near the infrared ray sensor 45, causes the light emitting element to light up for indicating a position at which a pan should be placed, further changes the brightness of the light emitting device until heating is started, and checks reactions of the infrared ray sensor with respect to a brightness change. This enables detection of abnormalities in the infrared ray sensor.

However, the above structure generally causes the temperature to rise to a high temperature around the infrared ray sensor, thereby inducing a problem that if the light emitting element is continuously lighted in such an environment, the performance of the light emitting element is early degraded due to the use thereof for a long period of time. Further, in the above structure, the light emitting element is continuously lighted, thereby inducing a problem that extra electric power is continuously consumed even while no heating cooking is performed.

An object of the present invention is to improve the issues described above and to provide an induction heating cooker capable of improving durability of a light emitting device and also reducing the electric power consumed by the light emitting device.

Means for Solving the Problems

In order to overcome the above-described problems in the related art, an induction heating cooker according to the present invention is structured to turn off a light emitting device, after a lapse of a predetermined time (a preset standby time) since a stop of a heating operation by a heating control unit.

This can cause the position of the infrared ray sensor to be recognized through the light emission from the light emitting device provided near the infrared ray sensor and, also, can reduce the time for which the light emitting device is lighted, thereby improving durability of the light emitting device and also reducing electric power consumed by the light emitting device.

In a first aspect of the present invention, there is provided an induction heating cooker including:

a top plate on which a cooking container is placed, the top plate being made of a material capable of passing light;

a heating coil adapted such that a high-frequency current is flowed though the heating coil for performing induction heating on the cooking container;

an infrared ray sensor having an incidence opening below the top plate and being adapted to detect infrared rays which have been entered the incidence opening by passing through the top plate and radiated from a bottom surface of the cooking container;

a light emitting device for emitting light to a back surface of the top plate from a light emitting unit placed near the incidence opening;

one or more operation units for inputting command information;

a power-supply switch for causing a transition from a power-supply off state to a standby state, wherein the power-supply off state is a state where inputting operations through any of the operation units are not allowed, and wherein the standby state is a state where inputting of the command information through some of the operation units is allowed and a heating operation of the heating coil is stopped; and a heating control unit for controlling the heating coil based on an output of the infrared ray sensor to control an operation for heating the cooking container;

wherein, when at least the transition from the power-supply off state to the standby state is caused by operating the power-supply switch, the light emitting device starts light emission with a first luminance, and after a lapse of a preset standby time since the stop of the heating operation at a heating-operation stopped state, the light emitting device stops the light emission or emits light with a second luminance lower than the first luminance.

In a second aspect of the present invention, there is provided the induction heating cooker according to the first aspect, further including a plurality of heating coils each identical to the heating coil, wherein the infrared ray sensor and the light emitting device are plurally provided in association with at least two or more heating coils out of the plurality of heating coils, the plurality of light emitting devices stop the light emission or perform the light emission with the second luminance, independently of one another, in conjunction with the stop of the heating operations of the corresponding heating coils.

In a third aspect of the present invention, there is provided the induction heating cooker according the first aspect, further including a plurality of heating coils each identical to the heating coil, wherein the infrared ray sensor and the light emitting device are plurally provided in association with at least two or more heating coils out of the plurality of heating coils, the plurality of light emitting devices stop the light emission or perform the light emission with the second luminance, after the lapse of the standby time since the stop of all of the heating operations with the heating coils provided in association with the light emitting devices, at the heating-operation stopped state.

In a fourth aspect of the present invention, there is provided the induction heating cooker according to the first aspect, wherein the light emitting device stops the light emission or performs the light emission with the second luminance, when the standby time elapses since the stop of the heating operation at the heating-operation stopped state and at a state where there is no inputting to the operation units.

In a fifth aspect of the present invention, there is provided the induction heating cooker according to the first aspect, further including an input limiting unit for limiting the inputting to the operation units so as to prevent command information indicative of starting the heating operation from being inputted to the operation units, when a preset second standby time elapses at the heating-operation stopped state, wherein the light emitting device stops the light emission while the input limiting unit limits the inputting to the operation units.

In a sixth aspect of the present invention, there is provided the induction heating cooker according to the first aspect, wherein the light emitting device starts the light emission with the first luminance, in a case where the command information is inputted through any of the operation units, when the light emitting device has stopped the light emission or has been emitting light with the second luminance.

In a seventh aspect of the present invention, there is provided the induction heating cooker according to the fifth aspect, wherein the input limiting unit eliminates the limit on the inputting to the operation units, when command information other than command information indicative of starting the heating operation is inputted to the operation units, and the light emitting unit starts the light emission with the first luminance, when the limit on the inputting to the operation units is eliminated.

In an eighth aspect of the present invention, there is provided the induction heating cooker according to the first aspect, further including a human-detection sensor for detecting a person existing around the human-detection sensor, wherein the light emitting devices starts the light emission when the human detection sensor detects a person existing around the human-detection sensor for a preset third standby time.

Effects of the Invention

With the induction heating cooker according to the present invention, a light emitting device is extinguished as long as possible while a heating operation is stopped. This can improve durability of the light emitting device, which enables maintaining a function of clearly indicating a position at which a cooking container should be placed and a function of detecting failures in an infrared ray sensor, which are roles of the light emitting device. Further, it is possible to reduce electric power consumed by the light emitting device.

Further, with the induction heating cooker according to the first aspect of the present invention, it is possible to reduce the time for which the light emitting device is lighted, thereby improving the durability of the light emitting device and reducing the electric power consumed by the light emitting device.

Further, with the induction heating cooker according to the second aspect of the present invention, it is possible to cause the plural light emitting devices to stop light emission independently of one another, which enables driving only a light emitting device required to emit light, thereby improving the durability of the respective light emitting devices as much as possible.

Further, with the induction heating cooker according to the third aspect of the present invention, when a single heating coil has stopped the heating operation and the light emitting device associated with this single heating coil is extinguished, while another heating coil performs a heating operation or has stopped the heating operation before the elapse of a standby time, and the light emitting device associated with the another coil is lighted, it is possible to prevent the user from wrongly recognizing that there is a failure in the light emitting device associated with the single heating coil which has stopped the heating operation.

Further, with the induction heating cooker according to the fourth aspect of the present invention, it is possible to accurately determine whether or not the user will not use the cooker, in consideration of both the time elapsed since the stop of a heating operation and the continuation of a state where there is no inputting to the operation units. Further, it is possible to increase the adequacy of the extinguishment of the light emitting device.

Further, with the induction heating cooker according to the fifth aspect of the present invention, if a second standby time elapses at the heating-operation stopped state, the inputting to the operation units is limited, so as to prevent command information indicative of starting (restarting) the heating operation from being inputted thereto. This can prevent a heating operation from being started before the light emitting device emits light.

Further, with the induction heating cooker according to the sixth aspect of the present invention, if the command information is inputted through any of the operation units when the light emitting device has stopped the light emission or has been emitting light with the second luminance, the light emission is started with the first luminance. This enables clearly indicating the position at which a cooking container should be placed and detecting failures in the infrared ray sensor, which are the roles of the light emitting device, when the heating operation is started.

Further, with the induction heating cooker according to the seventh aspect of the present invention, if command information other than command information indicative of starting a heating operation is inputted to the operation units, the limit on the inputting to the operation units is eliminated, and the light emitting device starts light emission. Accordingly, the light emitting device can be reliably lighted before a heating operation is started. This enables clearly indicating the position at which a cooking container should be placed and also detecting failures in the infrared ray sensor, which are the roles of the light emitting device, before the start of a heating operation.

Further, with the induction heating cooker according to the eighth aspect of the present invention, if a human detection sensor detects a person existing around the human detection sensor, the light emitting device starts light emission. Accordingly, the light emitting device can be reliably lighted before the start of a heating operation. This enables clearly indicating the position at which a cooking container should be placed and also detecting failures in the infrared ray sensor, which are the roles of the light emitting device, before the start of a heating operation.

BRIEF DESCRIPTION OF THE DRAWINGS

These and other aspects and features of the present invention will become clear from the following description taken in conjunction with the preferred embodiments thereof with reference to the accompanying drawings, in which.

BEST MODES FOR CARRYING OUT THE INVENTION

Hereinafter, embodiments of the present invention will be described with reference to the drawings. Note that the present invention is not limited to these embodiments.

《First Embodiment》

Figure 1:
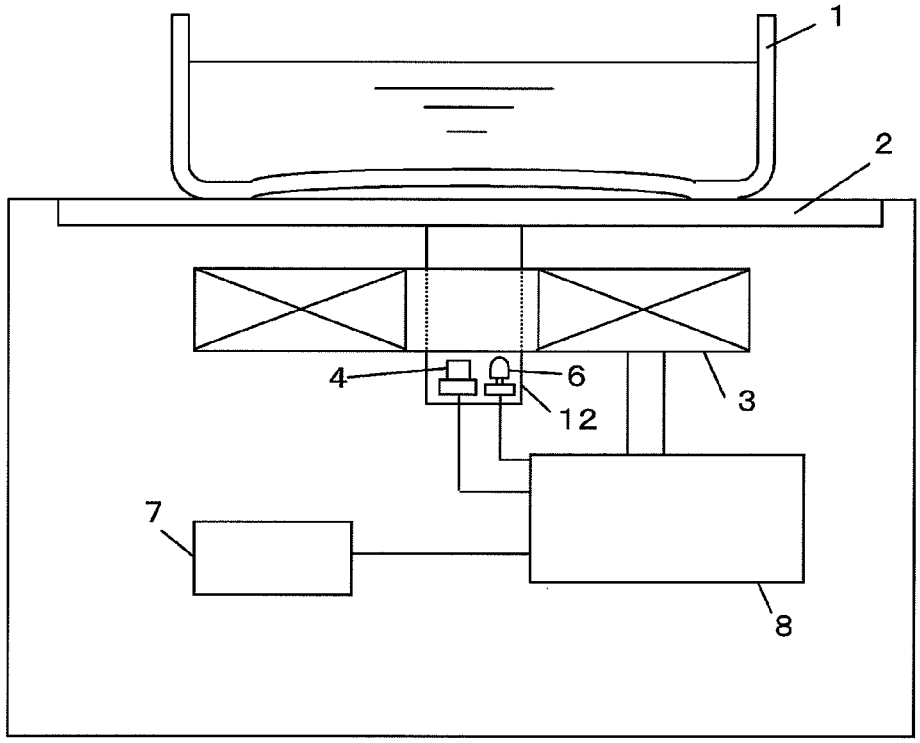
FIG. 1 is a schematic view of a structure of an induction heating cooker according to a first embodiment of the present invention.

FIG. 1 illustrates a schematic view of a structure of an induction heating cooker according to a first embodiment of the present invention.

In FIG. 1, a top plate 2 is a plate-shaped member for placing a cooking container 1 thereon. Below the top plate 2, there are provided a heating coil 3, an infrared ray sensor 4, a temperature detection device (not illustrated), a light emitting device 6, and an operation unit 7. The infrared ray sensor 4 is placed such that it is faced to the bottom portion of the cooking container 1 with the top plate 2 interposed therebetween. The temperature detection device, which is not illustrated in FIG. 1, is connected between the infrared ray sensor 4 and the heating control unit 8 and is adapted to convert an amount of energy received by the infrared ray sensor 4 into the temperature of the cooking container 1. The light emitting device 6 is constituted by a light emitting element such as a light emitting diode (LED), which is an example of a light emitting unit mounted such that it is oriented toward the top plate 2. The heating control unit 8 flows a high-frequency current to the heating coil 3 for performing heating control on the cooking container 1. Further, the induction heating cooker according to the first embodiment of the present invention includes one or more operation units for inputting command information, and a power-supply switch for causing a transition from a power-supply off state where inputting operations through any of the operation units are not allowed to a standby state where inputting of command information through some of the operation units is allowed and also the heating operation of the heating coil 3 is stopped.

Hereinafter, an induction heating cooker having the above structure will be described with respect to operations and effects thereof.

At first, if a command for starting a heating operation is generated to the induction heating cooker through the operation unit connected to the heating control unit 8, which is not illustrated, the heating control unit 8 supplies a high-frequency current to the heating coil 3 which is connected thereto. At this time, the cooking container 1 is placed on the top plate 2 above the heating coil 3 at a state where the cooking container 1 is magnetically coupled to the heating coil 3. The heating coil 3 being supplied with the high-frequency current generates a high-frequency magnetic field. Due to the high-frequency magnetic field, eddy currents flow through the cooking container 1 due to the electromagnetic induction, which induces Joule heat, thereby applying induction heating to the cooking container 1.

The infrared ray sensor 4 has an incidence opening below the top plate 2 and receives (detects) infrared rays which have been radiated from the bottom surface of the cooking container 1 and entered the incidence opening by passing through the top plate 2. Information indicative of the reception of infrared rays by the infrared ray sensor 4 is transmitted to the temperature detection device. The temperature detection device calculates the temperature of the cooking container 1 from the amount of energy received by the infrared ray sensor 4 and transmits information about the temperature to the heating control unit 8.

The heating control unit 8 controls an amount of heating electric power to an amount of heating electric power specified by a user and also suppresses the amount of heating electric power or stops the heating operation according to the temperature information obtained from the temperature detection device. For example, when a heating operation is started in a mode for cooking for fried foods, the heating control unit 8 controls the amount of heating electric power such that the temperature of the cooking container 1 is maintained at a predetermined temperature. Further, if the temperature of the cooking container 1 becomes abnormally high during normal heating, the heating control unit 8 suppresses the amount of heating electric power or stops the heating operation. This can ensure safety in order to prevent an occurrence of ignition of oil and the like. The heating control unit 8 may either be integrated with the temperature detection device or be formed from a DSP (Digital Signal Processor) or a microcomputer or the like. Note that the present invention is not limited thereto, and the heating control unit 8 can be also formed from a custom IC or the like.

In this case, the cooking container 1 is magnetically coupled to the heating coil 3 and is made of a magnetic material, in general. Further, when the cooking container 1 is made of a nonmagnetic material with a low resistance, such as copper or aluminum, the cooking container 1 cannot be heated by a normal induction heating cooker. However, in recent years, induction heating cookers capable of heating even metals with low resistances have been practically used and, therefore, by structuring the induction heating cooker according to the first embodiment such that it is capable of heating even metals with low resistances, it is possible to employ a cooking container 1 made of a metal with a low resistance. Further, induction heating cookers are generally designed such that the induction heating cookers are not capable of heating a cooking container 1 when the cooking container 1 has a small diameter or there is a large gap between the top plate 2 and the cooking container 1.

The top plate 2 is a portion of the induction heating cooker which forms an external appearance thereof and is a plate-shaped member for placing the cooking container 1 thereon. The top plate 2 is made of a material capable of passing light therethrough, such as a heat-resistant toughened glass, and is advantageous in terms of ease of cleaning and aestheticization since it has a flat placement surface.

The infrared ray sensor 4 is adapted to receive infrared rays radiated from the cooking container 1. It is also possible to provide a plurality of such infrared ray sensors 4. Further, a conventional induction heating cooker employs a contact-type temperature sensor such as a thermocouple or thermistor which is mounted in contact with the lower portion of the top plate 2. When the cooking container 1 is heated, the upper portion of the top plate 2 is heated due to heat conduction and heat radiation at the portion of the top plate 2 which contacts with the bottom portion of the cooking container 1, and the heat therein is transferred to the lower portion of the top plate 2. In such a conventional induction heating cooker, the temperature of the lower portion of the top plate 2 is determined by the contact-type temperature sensor. In other words, in such a conventional induction heating cooker, the temperature of the bottom portion of the cooking container 1 is determined indirectly through the top plate 2. This has induced the problem that the responsivity to the temperature variation in the cooking container 1 is influenced by the size of the area of the top plate 2 which contacts with the cooking container 1 and by the thermal capacity of the top plate 2. However, by employing an infrared ray sensor 4 as in the induction heating cooker according to the first embodiment, infrared rays from the cooking container 1 are directly received by the infrared ray sensor 4, thereby offering the advantage of excellent responsivity to the temperature variation in the cooking container 1. That is, with the induction heating cooker according to the first embodiment, it is possible to prevent the responsivity to the temperature variation in the cooking container 1 from being influenced by the size of the area of the top plate 2 which contacts with the cooking container 1 and by the thermal capacity of the top plate 2.

Further, for example, when the cooking container 1 is heated at a state with no object to be heated contained therein, the temperature of the cooking container 1 abruptly rises. If oil is dropped into the cooking container 1 at this state, this may induce ignition. Therefore, the induction heating cooker according to the first embodiment is provided with a safety device (not illustrated), in order to prevent the temperature of the cooking container 1 from rising to a temperature equal to or higher than an ignition temperature of oil. A conventional induction heating cooker induces a delay with respect to a temperature variation in the cooking container 1 (poor responsivity) as described above, and therefore, the safety device is designed so as to be able to stop the heating operation in such a way as to provide a sufficient leeway before the ignition temperature of oil is reached. However, in this case, the safety device may function even during a heating operation for preheating a frying pan or the like, which may degrade the usability. On the contrary, the induction heating cooker according to the first embodiment employs the infrared ray sensor 4, which eliminates the necessity of considering the leeway for addressing the delay of the thermal responsivity. This can avoid the occurrence of such a situation.

The temperature detection device is adapted to convert the output of the infrared ray sensor 4 into a temperature. The energy received by the infrared ray sensor 4 is converted into a voltage, an electric current, or a frequency which is determined by this energy, and this physical value resulted from the conversion is outputted. The temperature detection device converts this physical value into the temperature. The temperature resulted from the conversion is utilized as information required for control of the amount of heating electric power. The temperature detection device has a function of receiving the physical value from the infrared ray sensor 4, a function of converting this physical value into the temperature, and a function of outputting the temperature resulted from the conversion. The information about the temperature resulted from the conversion is transmitted to the heating control unit 8. The heating control unit 8 performs various controls according to this temperature.

In the first embodiment, it is preferable that the bottom portion of the cooking container 1 covers the entire detection area of the infrared ray sensor 4, and all the energy detected by the infrared ray sensor 4 is infrared ray energy from the cooking container 1. If there is a portion of the detection area of the infrared ray sensor 4 which is not covered with the bottom portion of the cooking container 1, disturbing light may intrude into this portion, and the infrared ray sensor 4 may receive the energy of this disturbing light. The energy of such disturbing light is higher than the infrared ray energy radiated from the cooking container 1. This makes it impossible to detect the infrared ray energy from the cooking container 1.

In order to avoid the occurrence of such a situation, the light emitting unit of the light emitting device 6 is provided near the incidence opening of the infrared ray sensor 4, in the first embodiment. The light emitting device 6 emits light from the light emitting unit toward the top plate 2, which can clearly inform the user the position of the infrared ray sensor 4, namely the optimum position at which the cooking container 1 is placed. This can urge the user to cover the infrared ray sensor 4 entirely with the bottom portion of the cooking container 1 in performing cooking.

Further, by changing the light output of the light emitting device 6 and further detecting the change of the output of the infrared ray sensor 4 at this time, when the infrared ray sensor 4 is covered with the bottom portion of the cooking container 1, it is possible to check whether or not there is a failure in the infrared ray sensor 4.

Next, with reference to FIG. 2, operations for turning off the light emitting device 6 will be described.

Figure 2:
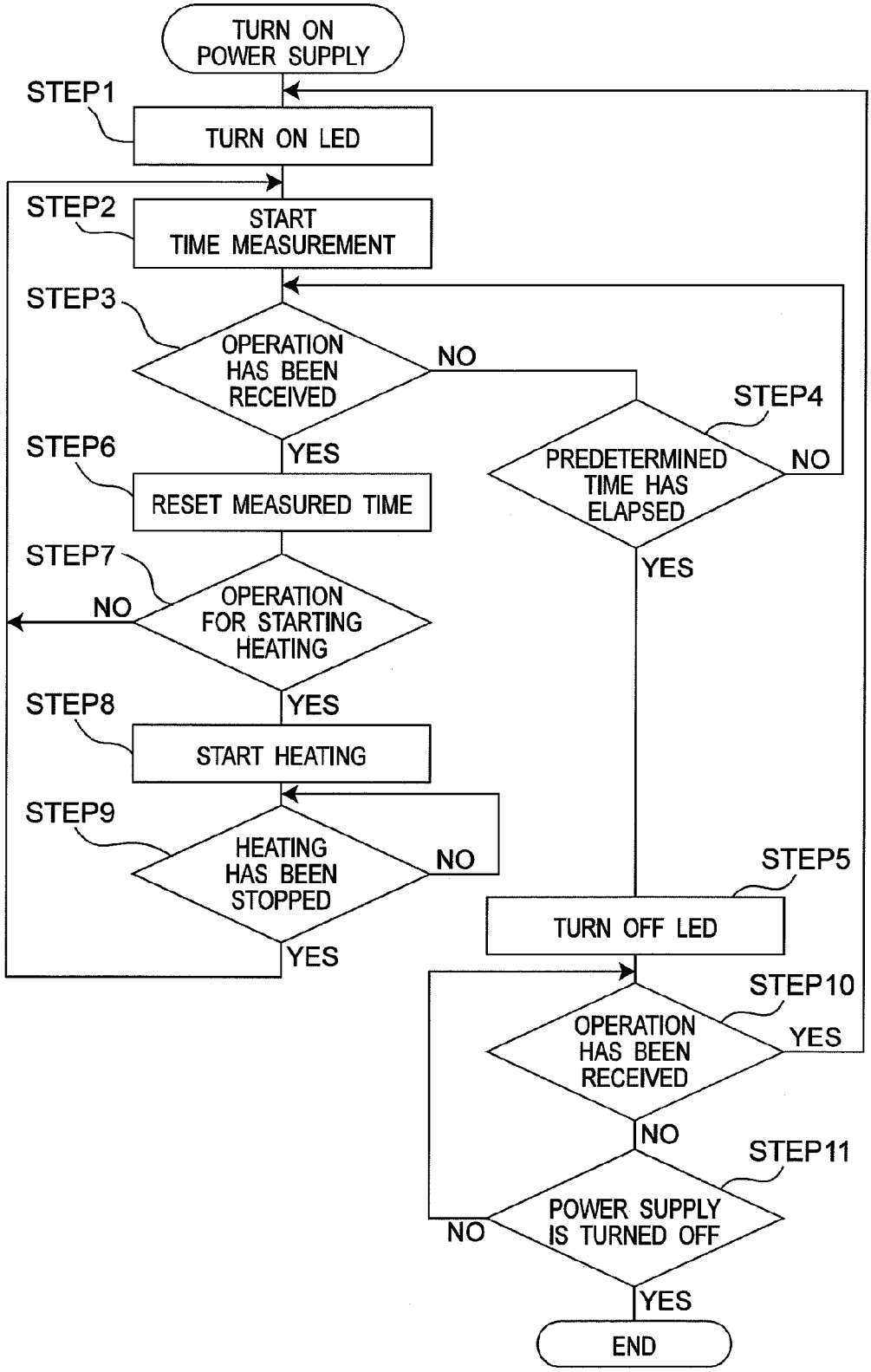
FIG. 2 is a flow chart of operations for turning off a light emitting device according to the first embodiment of the present invention.

FIG. 2 is a flow chart of operations for turning off the light emitting device in the induction heating cooker according to the first embodiment of the invention.

If the power-supply switch (not illustrated) is turned on at first, the LED which is an example of the light emitting device 6 is lighted in STEP 1. This induces the transition from a power-supply off state where inputting operations through any of the operation units are not allowed to a standby state where inputting of command information through some of the operation units is allowed and also the heating operation of the heating coil 3 is stopped. Further, at this time, only the LED is lighted, and no heating operation and the like is performed.

In STEP 2, time measurement is started.

In STEP 3, an operation (inputting) by the user to the operation unit is waited for. If no operation is performed by the user, the operation shifts to STEP 4. If an operation by the user to the operation unit is received, the operation shifts to STEP 6.

In STEP 4, it is determined whether or not the time which has been measured since STEP 2 indicates that a predetermined time (a preset standby time: 5 minutes in the first embodiment) has elapsed. If the predetermined time has elapsed, the operation shifts to STEP 5. On the other hand, if the predetermined time has not elapsed, the operation returns to STEP 3.

In STEP 5, the LED is turned off. After the LED is turned off in STEP 5, the operation shifts to STEP 10 which will be described later.

In STEP 6, the time measurement since STEP 2 is reset.

In STEP 7, it is determined whether or not the operation performed by the user is an operation for starting a heating operation. If the operation performed by the user is not an operation for starting the heating operation, the operation returns to STEP 2. On the other hand, if the operation performed by the user is an operation for starting the heating operation, the operation shifts to STEP 8.

In STEP 8, heating of the cooking container 1 is started.

In STEP 9, it is determined whether or not the heating operation on the cooking container 1 has been stopped. At this time, there are various cases which cause the heating operation to be stopped. For example, there is a case where the user performs an operation for stopping the heating operation or a case where the induction heating cooker itself automatically stops the heating operation on detecting the cooking container 1 having been removed from the top plate 2 during the heating operation.

If it is detected that the heating operation has been stopped, the operation returns to STEP 2.

As described above, with the induction heating cooker according to the first embodiment, if a predetermined time elapses at a state where the heating operation is stopped and also no operation by the user has been received, the LED is automatically turned off.

In STEP 10, it is determined whether or not an operation by the user has been received. If an operation by the user has been received, the operation returns to STEP 1 where the LED is turned on. Further, the user's operation in STEP 10 can be considered to indicate that the user will perform heating cooking from now. Accordingly, by turning on the LED on receiving the operation by the user, it is possible to inform the user the position of the infrared ray sensor 4. This enables the user to reliably place the cooking container 1 above the infrared ray sensor 4. This causes all the energy detected by the infrared ray sensor 4 to be infrared ray energy from the cooking container 1.

Finally, if the power-supply switch is turned off in STEP 11, this causes the transition to the power-supply off state, and the series of operation is ended.

Next, with reference to FIGS. 1 and 3, there will be described the conjunction of operations of the operation unit 7 and operations of the light emitting device 6. In this case, the operation unit 7 enables inputting of information about commands from the user in relation to heating operations, such as information about commands for starting and stopping heating operations, information about selection of menus, information about setting of cooking times.

Figure 3:
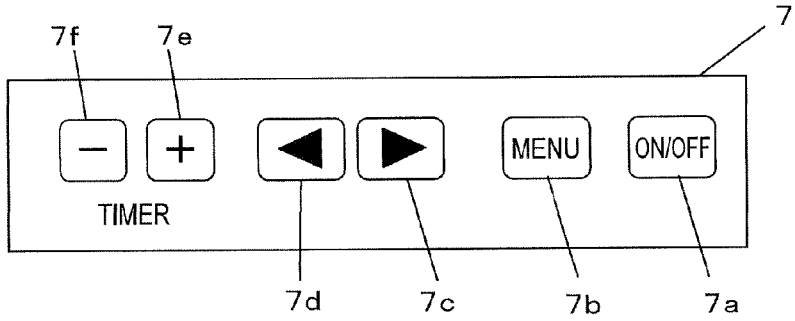
FIG. 3 is a view illustrating a portion of an operation unit in the induction heating cooker according to the first embodiment of the present invention.

FIG. 3 illustrates a portion of the operation unit 7 in the induction heating cooker according to the first embodiment of the present invention.

Referring to FIG. 3, the operation unit 7 is constituted by operation keys 7*a* to 7*f*.

The operation key 7*b* is a menu key for selecting menus. In this case, these menus are heating operation modes in the induction heating cooker. These menus include a normal heating mode, a fried-food mode for maintaining the temperature of the inside of the cooking container 1 at a predetermined temperature while performing temperature control, a water boiling mode, and an auto rice-cooking mode. The menu key 7*b* plays a role in selecting these menus.

The operation key 7*a* is an ON/OFF key, which is a key for turning on and off the heating operation for the menu selected through the menu key 7*b*.

The operation key 7*c* is an UP key, and the operation key 7*d* is a DOWN key. The UP key 7*c* and the DOWN key 7*d* play different roles depending on the menu. The UP key 7*c* and the DOWN key 7*d* are used for simply increasing and decreasing the heating power in the case where the menu is the heating mode, for example, and are used for increasing and decreasing the set temperature of the inside of the cooking container 1 in the case where the menu is the fried-food mode. Further, the UP key 7*c* and the DOWN key 7*d* are used for setting the number of unit volumes of rice to be cooked, in the case where the menu is the auto rice-cooking mode.

The operation key 7*e* is a timer UP key, and the operation key 7*f* is a timer DOWN key. These two operation keys 7*e* and 7*f* are used for directly setting the time for which the heating cooking should be continued, for example. After the elapse of the time set through the operation keys 7*e* and 7*f*, the heating operation is automatically stopped.

Hereinafter, there will be described, in details, operations of the induction heating cooker according to the first embodiment.

First, if the power-supply switch (not illustrated) for supplying a commercial power supply is turned on, the induction heating cooker is supplied with the commercial power supply. At this time, the transition from the power-supply off state to the standby state occurs, and the light emitting device 6 is lighted, thereby clearly indicating the position at which the cooking container 1 should be placed.

If there has been continuously no input to the operation unit for 5 minutes, which is an example of a predetermined time (a preset standby time), since the light emitting device 6 has been turned on, the light emitting device 6 is turned off.

On the other hand, if the user pushes the menu key 7*b* after the power-supply switch has been turned on, the heating operation mode is selected. If the operation unit 7 is operated (an operation key is pushed) within 5 minutes after the power-supply switch has been turned on, the light emitting device 6 continues its lighting state.

Next, if the user pushes the ON/OFF switch 7*a* for performing a heating operation for the menu which the user has selected, a heating operation is started. Further, in cases of making setting of the heating power during heating cooking, the user can make setting of the heating power by operating the UP key 7*c* or the DOWN key 7*d*. Further, in cases of cooking with low heating power for a long period of time, such as in cases of stewing and the like, it is significantly effective to perform timer cooking. In this case, the user can set the timer, by operating the timer UP key 7*e* or the timer DOWN key 7*f*.

While the heating cooking is continued after a key operation has been performed as described above, the light emitting device 6 is kept lighted. This enables the user to check whether or not the cooking container 1 is placed at an appropriate position at which it covers the infrared ray sensor 4, thereby causing the infrared ray sensor 4 to accurately operate. However, the light emitting device 6 can be lighted in any manner which enables the user to recognize the position of the infrared ray sensor 4. For example, the light emitting device 6 can be lighted intermittently, instead of continuously.

Further, it is preferable that the light emitting device 6 is kept lighted for a while after the completion of the heating cooking. This is because, after a heating cooking using a frying pan, for example, is completed and the operation is stopped, it is necessary to provide a certain amount of interval before restarting another cooking, which can be said for cooking in ordinary households. In other words, in this case, it is preferable that the position of the infrared ray sensor 4 can be continuously checked, in view of usability.

Further, after a heating operation has been temporarily stopped, if there is continuously no input to the operation unit 7 at the heating-operation stopped state, it can be determined that the user will not restart a cooking operation subsequently.

In the first embodiment, if the heating-operation stopped state is continued for 5 minutes, it is determined that the user will not restart a cooking operation immediately, and the light emission from the light emitting device 6 is stopped (extinguished).

If a user's operation is received again by the operation unit 7, at the state where the light emitting device 6 is extinguished, the light emitting device 6 is lighted again. That is, in the first embodiment, if the heating-operation stopped state is continued for 5 minutes, it is determined that the user will not restart a cooking operation immediately, and the light emission from the light emitting device 6 is temporarily stopped, and if an user's operation is received by the operation unit 7 again, it is determined that there is a possibility that a cooking operation will be restarted, and the light emitting device 6 is immediately lighted. Hereinafter, the additional description of operations regarding this case will be given below.

In the first embodiment, after the elapse of a second predetermined time (a preset second standby time: 1 minute in the first embodiment) at the heating-operation stopped state, the operation keys in the operation unit 7 which are allowed to be operated by the user are limited to the menu key 7*b*. That is, in the first embodiment, there is further provided an input limiting unit (not illustrated) which limits the operations of the operation unit 7. The light emitting device 6 is extinguished after the input limiting unit has functioned. Therefore, in order to light the light emitting device 6 again, it is necessary at least that the menu key 7*b* is pushed. If the menu key 7*b* is pushed to select an operation mode and then the ON/OFF key 7*a* is pushed, a heating operation is started. That is, even after the light emitting device 6 has been temporarily extinguished, the light emitting device 6 is reliably brought into a lighting state before a heating operation is started again. In other words, the light emitting device 6 is at a lighting state, in any case, before a heating operation is started. Accordingly, the light emitting device 6 can reliably play a role in informing the user the position of the infrared ray sensor 4, namely the position at which the cooking container 1 is desired to be placed.

As described above, in the induction heating cooker according to the first embodiment, if a time equal to or longer than a predetermined time has elapsed at a state where the heating operation is stopped and also no user's operation is received, the LED which is an example of the light emitting device 6 is automatically extinguished. This can improve the durability of the LED and also can reduce the electric power consumed by the LED.

Note that, in the first embodiment, the predetermined time is set to 5 minutes, but the predetermined time is not necessarily limited thereto. For example, the predetermined time is only required to be a time which does not cause the user to feel inconvenience or have a complaint about the LED being turned off, in using the cooker again.

Further, while, in the first embodiment, the light emitting device 6 is adapted to be changed over between a lighted state and an extinguished state, the present invention is not limited thereto. For example, these two states can be expressed by changing a luminance of the light emitting device 6. That is, the lighted state of the light emitting device 6 can be indicated with a first luminance, while the extinguished state of the light emitting device 6 can be indicated with a second luminance lower than the first luminance. In this case, it is also possible to provide the same effects as those in the first embodiment.

Further, while, in the first embodiment, the light emitting device 6 is constituted by an LED, the light emitting device 6 is not limited thereto and can be any device which at least enables the user to recognize the light emission therefrom. Further, when the light emitting device 6 is also required to be used for detection of failures in the infrared ray sensor, it is desirable to select a device as the light emitting device 6, such that the change of the output of the light emitting device 6 causes the output of the infrared ray sensor 4 to change by amounts with detectable levels.

Further, while, in the first embodiment, the second predetermined time until the input limiting unit for limiting operations of the operation unit 7 functions is set to 1 minute, the present invention is not limited thereto. The second predetermined time is only required to be a time which does not cause the user to feel inconvenience, in continuing cooking. Further, the input limiting unit is provided mainly for the purpose of preventing the user from unintentionally pushing operation keys to start a heating operation carelessly and, therefore, if the second predetermined time is set to be excessively long, this will reduce the effect for attaining the original purpose. Accordingly, it is preferable to set the second predetermined time in consideration of the balance between the two factors described above.

Further, while, in the first embodiment, the predetermined time is set to be 5 minutes, and the second predetermined time is set to be 1 minute, so that both the times are set to be different times, it is not necessary to set both the times to be different times. However, as described in the first embodiment, it is necessary that the predetermined time is at least equal to or longer than the second predetermined time. Further, by setting the predetermined time and the second predetermined time to be the same, it is possible to cause the user to recognize that the state where the light emitting device 6 is extinguished is equal to the state where there is exerted a limit on the operation unit 7, when viewed by the user. For example, when the light emitting device 6 is simply extinguished, the user may have difficulty in distinguishing whether this state is a normal state or a state where there is a failure. However, by causing the extinguishment of the light emitting device 6 to be synchronized with another operation, it is possible to prevent the occurrence of wrong recognition that there is a failure in the light emitting device 6. This can improve the usability.

Further, while, in the first embodiment, if the menu key 7*b* is pushed at a state where the light emitting device 6 is extinguished, the light emitting device 6 is lighted again, the present invention is not limited thereto. For example, since it is necessary only to prevent a heating operation from being directly started, the light emitting device 6 can be adapted such that, if an operation key other than the operation key for turning on and off a heating operation is pushed, the light emitting device 6 is lighted again. Further, the trigger for lighting of the light emitting device 6 is not limited to an operation to the operation unit 7. For example, it is also possible to further provide a human detection sensor for detecting movement of a person around the cooker (the periphery thereof) such that the light emitting device 6 is lighted if the human detection sensor detects a sign of a person.

Second Embodiment

An induction heating cooker according to the second embodiment of the present invention will be described, with reference to FIGS. 1 to 4. Note that the same components as those described in the first embodiment will be designated by the same reference characters and will not be described hereinafter.

Figure 4:
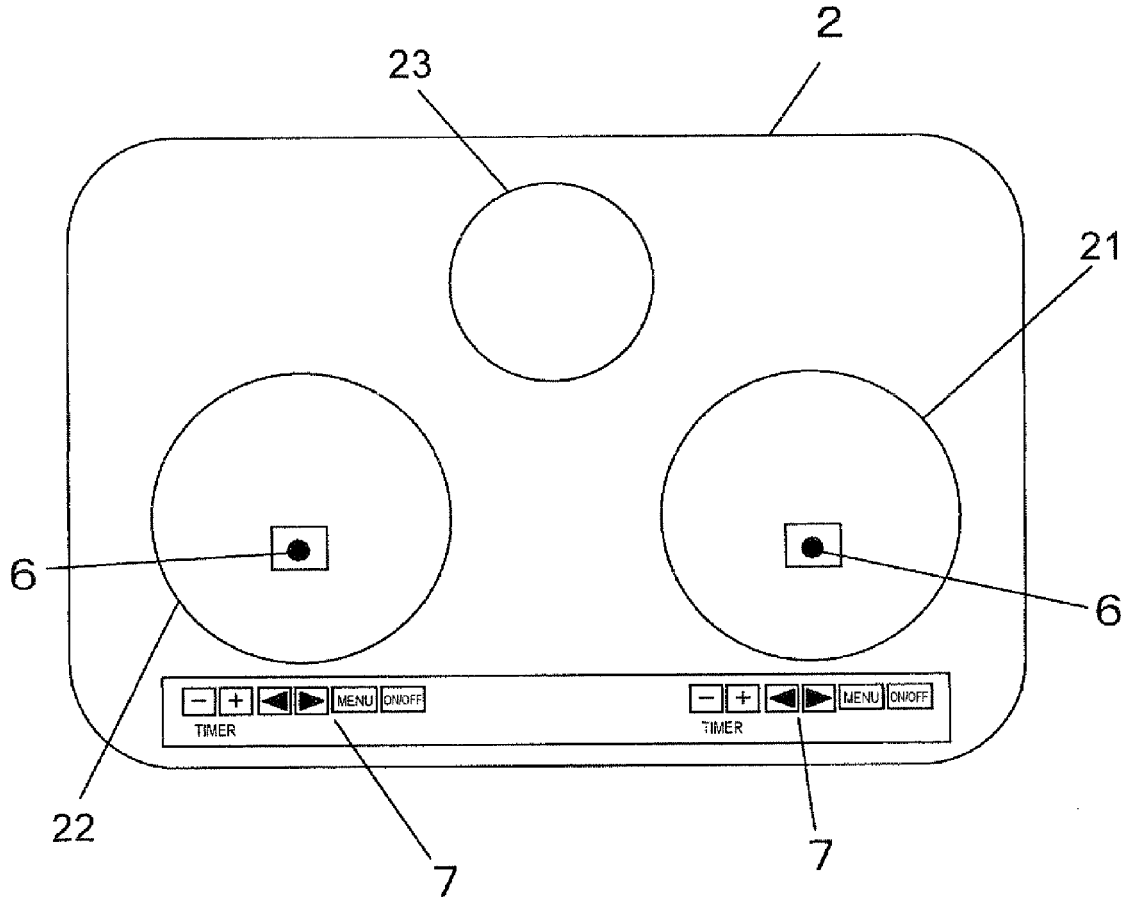
FIG. 4 is a top view of an induction heating cooker according to a second embodiment of the present invention.
Figure 5:
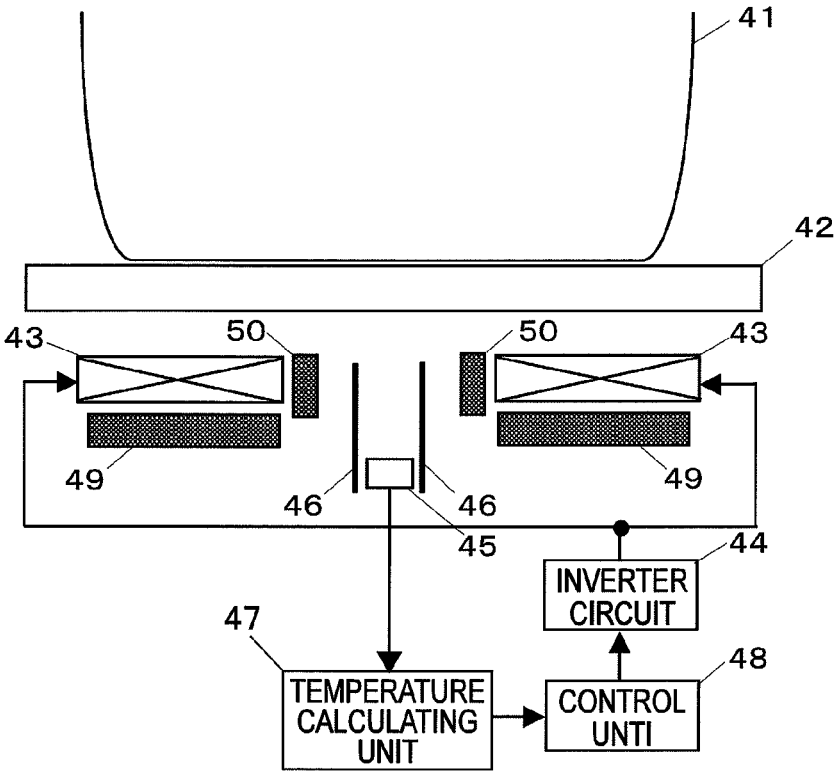
FIG. 5 is a schematic view of a structure of a conventional induction heating cooker.

FIG. 4 illustrates a view of a top plate 2 in the induction heating cooker according to the second embodiment of the present invention, viewed from above.

Referring to FIG. 4, there are formed two sets of operation units 7, such that the right set is for operating a right burner 21, and the left set is for operating a left burner 22. An operation unit for operating a rear burner 23 does not exist on the top plate 2 and is placed on a side surface of the induction heating cooker, although not illustrated.

In this case, in FIG. 4, there are illustrated the right burner 21, the left burner 22, and the rear burner 23 on the top plate 2, which indicate the positions of heating devices. Below the top plate 2, heating coils 3 in association with the respective burners are placed.

Light emitting devices 6 are placed substantially near the centers of the left burner 22 and the right burner 21. In FIG. 4, the light emitting devices 6 are illustrated by black points for ease of understanding. However, in the actual cooker, it is not necessary that the presence of the devices is recognized when extinguished, and the devices are only required to emit light for clearly indicating these units when lighted.

Further, the rear burner 23 is structured such that no infrared ray sensor 4 and no light emitting device 6 are provided therefor. This is because, in general, the heating power of the rear burner 23 is set to be lower, and it can be considered that there are not a sufficient necessity and effect of performance realized by provision of an infrared ray sensor 4. That is, it is not necessary to provide infrared ray sensors 4 in association with all the burners, as in the first embodiment.

In the above-described structure, the operations of the left burner 22 and the right burner 23 including the operations of the light emitting device 6 are adapted to act independently as illustrated in a flow chart in FIG. 2. That is, the operations for turning on and off the light emitting device 6 for each burner are performed independently.

This prevents these operations for turning on and off the light emitting device 6 for each burner from being influenced by the operations of the other burner, namely the operations of the other light emitting device 6. This enables maintaining the light emitting devices 6 extinguished as long as possible when they are not necessary. Accordingly, even in the induction heating cooker including the plural heating devices (the heating coils 3), it is possible to improve the durability of the light emitting devices 6 as much as possible. Further, for example, in cases where only the right burner 21 is used while the left burner 22 is not used, only the light emitting device 6 in the operated side is lighted. This can provide the advantage of clearly indicating which of the burners is being operated.

Note that, while, in the second embodiment, the number of heating devices, namely the burners, is three, the present invention is not limited thereto.

Further, in the second embodiment, the light emitting devices 6 for the respective burners are structured so as to operate individually. Accordingly, for example, in cases where the light emitting device 6 for a single burner is lighted but the light emitting devices 6 for the other burner is extinguished, the user may wrongly recognize that there is a failure in the extinguished light emitting device 6. For this reason, the light emitting devices 6 for the respective burners may be adapted to perform common operations. In this case, if there is continuously no input to the operation units 7 in all the burners having the light emitting devices 6 at a state where all the burners having the light emitting devices 6 are stopped, all the light emitting devices 6 may be extinguished. Further, at the time when inputting is performed to the operation unit 7 of any of the burners having the light emitting devices 6, all the light emitting devices 6 can be lighted. This enables integration of the specifications.

Further, while, in the second embodiment, the light emitting devices 6 are adapted to be changed over between a lighted state and an extinguished state, the lighted state of the light emitting devices 6 may be indicated with a first luminance, and the extinguished state of the light emitting devices 6 may be indicated with a second luminance lower than the first luminance, as described in the first embodiment.

Industrial Applicability

In the induction heating cooker according to the present invention, a light emitting device which is lighted for clearly indicating a position of an infrared ray sensor is adapted to be extinguished after a lapse of a predetermined time at a heating-operation stopped state, it is possible to improve durability of the light emitting device and also reduce power consumption. For example, the induction heating cooker according to the present invention is usable for applications of heating cookers and the like which employ infrared ray sensors.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

The entire disclosure of Japanese Patent Application No. 2007-164612 filed on Jun. 22, 2007, including specification, claims, drawings, and summary are incorporated herein by reference in its entirety.

The invention claimed is:

1. An induction heating cooker comprising:

a top plate on which a cooking container is placed, the top plate being made of a material capable of passing light;

a heating coil operable to perform induction heating of the cooking container by having a high-frequency current flow therethrough;

an infrared ray sensor having an incidence opening below the top plate and being adapted to detect infrared rays that have entered the incidence opening by passing through the top plate and being radiated from a bottom surface of the cooking container;

a light emitting device for emitting light to a back surface of the top plate from a light emitting unit placed near the incidence opening;

one or more operation units for inputting command information;

a power-supply switch for causing a transition from a power-supply off state to a standby state, the power-supply off state being a state in which inputting operations through any of the operation units are not allowed, and the standby state being a state in which inputting of the command information through some of the operation units is allowed and a heating operation of the heating coil is stopped; and a heating control unit for controlling the heating coil based on an output of the infrared ray sensor to control an operation for heating the cooking container, wherein, based on a change of an output of the infrared ray sensor when the light emitting device changes a light output, the induction heating cooker determines whether or not there is a failure in the infrared ray sensor, and wherein, when an operation of the power-supply switch causes the transition from the power-supply off state to the standby state, the light emitting device starts a light emission with a first luminance, and after a lapse of a preset standby time since a stop of the operation for heating the cooking container at a heating-operation stopped state, the light emitting device stops the light emission or emits light with a second luminance that is lower than the first luminance.

2. The induction heating cooker according to claim 1, further comprising a plurality of heating coils each being identical to the heating coil, a plurality of the infrared ray sensors and a plurality of the light emitting devices, wherein the plurality of infrared ray sensors and the plurality of light emitting devices are provided in association with at least two or more heating coils of the plurality of heating coils, and wherein each of the plurality of light emitting devices stops the light emission or performs the light emission with the second luminance, independently of one another, in conjunction with a stop of the heating operations of a corresponding heating coil of the plurality of heating coils.

3. The induction heating cooker according to claim 1, further comprising a plurality of heating coils each being identical to the heating coil, a plurality of the infrared ray sensors and a plurality of the light emitting devices, wherein the plurality of infrared ray sensors and the plurality of light emitting devices are provided in association with at least two or more heating coils of the plurality of heating coils, wherein each of the plurality of light emitting devices stops the light emission or performs the light emission with the second luminance, after the lapse of the standby time since a stop of all heating operations of the plurality of heating coils provided in association with the plurality of light emitting devices, at the heating-operation stopped state.

4. The induction heating cooker according to claim 1, wherein the light emitting device stops the light emission or performs the light emission with the second luminance, when the standby time elapses since the stop of the heating operation at the heating-operation stopped state and at a state where there is no inputting to the operation units.

5. The induction heating cooker according to claim 1, further comprising an input limiting unit for limiting the inputting to the operation units so as to prevent command information indicative of starting the heating operation from being inputted to the operation units, when a preset second standby time elapses at the heating-operation stopped state, wherein the light emitting device stops the light emission while the input limiting unit limits the inputting to the operation units.

6. The induction heating cooker according to claim 1, wherein the light emitting device starts the light emission with the first luminance, when the command information is inputted through any of the operation units, when the light emitting device has stopped the light emission or has been emitting light with the second luminance.

7. The induction heating cooker according to claim 5, wherein the input limiting unit eliminates the limit on the inputting to the operation units, when command information other than command information indicative of starting the heating operation is inputted to the operation units, and wherein the light emitting unit starts the light emission with the first luminance, when the limit on the inputting to the operation units is eliminated.

* * * * *